United States Patent [19]

Grinstead et al.

[11] Patent Number: 4,585,372

[45] Date of Patent: Apr. 29, 1986

[54] PIPELINE PLOUGH WITH LIFTING ASSEMBLIES

[75] Inventors: Timothy W. Grinstead, Ovingham; Alan R. Reece, Wylam, both of England

[73] Assignee: Soil Machine Dynamics Limited, Northumberland, England

[21] Appl. No.: 677,025

[22] Filed: Nov. 30, 1984

[30] Foreign Application Priority Data

Nov. 30, 1983 [GB] United Kingdom ..... 8331892

[51] Int. Cl.[4] ..... F16L 1/04

[52] U.S. Cl. ..... 405/159; 405/158; 405/169; 405/174

[58] Field of Search ..... 405/159, 160, 161, 162, 405/163, 164, 165, 180, 154, 157, 158, 181; 414/444, 745, 746, 747

[56] References Cited

U.S. PATENT DOCUMENTS

| | | | |
|---|---|---|---|
| 3,807,588 | 4/1974 | Bickman | 414/745 |
| 3,840,128 | 10/1974 | Swoboda, Jr. et al. | 414/745 |
| 4,280,289 | 7/1981 | Bassompierre-Sewrin | 405/163 |
| 4,428,132 | 1/1984 | Reece | 405/161 |

FOREIGN PATENT DOCUMENTS

| | | | |
|---|---|---|---|
| 116410 | 1/1983 | European Pat. Off. | 405/159 |

*Primary Examiner*—Cornelius J. Husar
*Assistant Examiner*—Kristina I. Hall
*Attorney, Agent, or Firm*—Cushman, Darby & Cushman

[57] ABSTRACT

The plough has a front and a rear lifting assembly (60, 62) each including an arm (64, 80) which is extensible and angularly adjustable by hydraulic rams (65, 68; 81, 84). The arms carry rollers (74, 76, 78; 94, 96, 98) upon which the pipeline (110) is lifted by the arms. The plough can be positioned beneath the pipeline as the arms retract while supporting the pipeline as the plough approaches the pipeline from one side. Having been positioned, the plough advances to cut a trench, the pipeline being supported in yielding manner by the two arms, having their lifting rams (68, 84) connected to hydraulic accumulators. Pressurized gas in the accumulators maintains the rollers (74, 76; 94, 96) in contact with the pipeline as the plough moves up and down and pitches relatively to the pipeline, during ploughing. The plough requires no structure over the pipeline. The plough body (12) is not required to comprise parts which separate to allow positioning of the plough in relation to the pipeline.

9 Claims, 8 Drawing Figures

PIPELINE PLOUGH WITH LIFTING ASSEMBLIES

BACKGROUND OF THE INVENTION

The invention relates to pipeline ploughs.

In a known type of pipeline plough two shares are movable apart and the plough is lowered over the pipeline on a supporting cable extending from a vessel on the sea surface. The plough is thus positioned on the sea-bed with the pipeline between shares. The pipeline is then raised and the shares are brought together beneath the pipeline before ploughing begins.

Such a plough has the disadvantage that bridging structure interconnecting the shares and extending over the pipeline is subject to relatively high loading.

Furthermore, during ploughing there is a risk that the pipeline or the plough will be damaged by large forces exerted mutually by the bridging structure and the pipeline upon each other. Such forces result from the movements of the plough relative to the pipeline during ploughing, especially movements in the vertical plane.

SUMMARY OF THE INVENTION

The object of the invention is to reduce or eliminate those disadvantages.

The invention avoids the need for separable shares and bridging structure joining the shares and extending over the pipeline.

According to the invention, a pipeline plough comprises a base structure, a plough body and ploughing depth adjusting means both said body and said means forming part of said base structure, front and rear lifting assemblies carried by said base structure and spaced apart in the lengthwise direction thereof, front and rear bearer means and front and rear actuator means forming parts of said front and rear assemblies, respectively, said actuator means being operable to adjust said respective assemblies to lift the pipeline supported by said bearer means while the plough is positioned to one side of the pipeline and to support the pipeline while the plough approaches the pipeline from said one side to position said plough body beneath the pipeline.

Preferably, a transverse beam ahead of the plough body is interconnected therewith by a longitudinal beam and ploughing depth adjusting means are connected to said transverse beam, the front and rear lifting assemblies being carried respectively by said transverse beam and said body and being mounted thereon at respective locations offset towards one side of said base structure, and front and rear actuator means form respective parts of said lifting assemblies and are operable to adjust the same.

Preferably, each said lifting assembly comprises members arranged in telescopic relationship to form an arm adjustable in length by relative telescopic movements of said members, said arm carrying said respective bearer means, said plough further comprising respective pivotal mounting means for each said arm providing a horizontal axis about which said arm is angularly adjustable.

BRIEF DESCRIPTION OF THE DRAWINGS

Forms of plough will now be described by way of example to illustrate the invention with reference to the accompanying drawings, in which.

Figure 1:
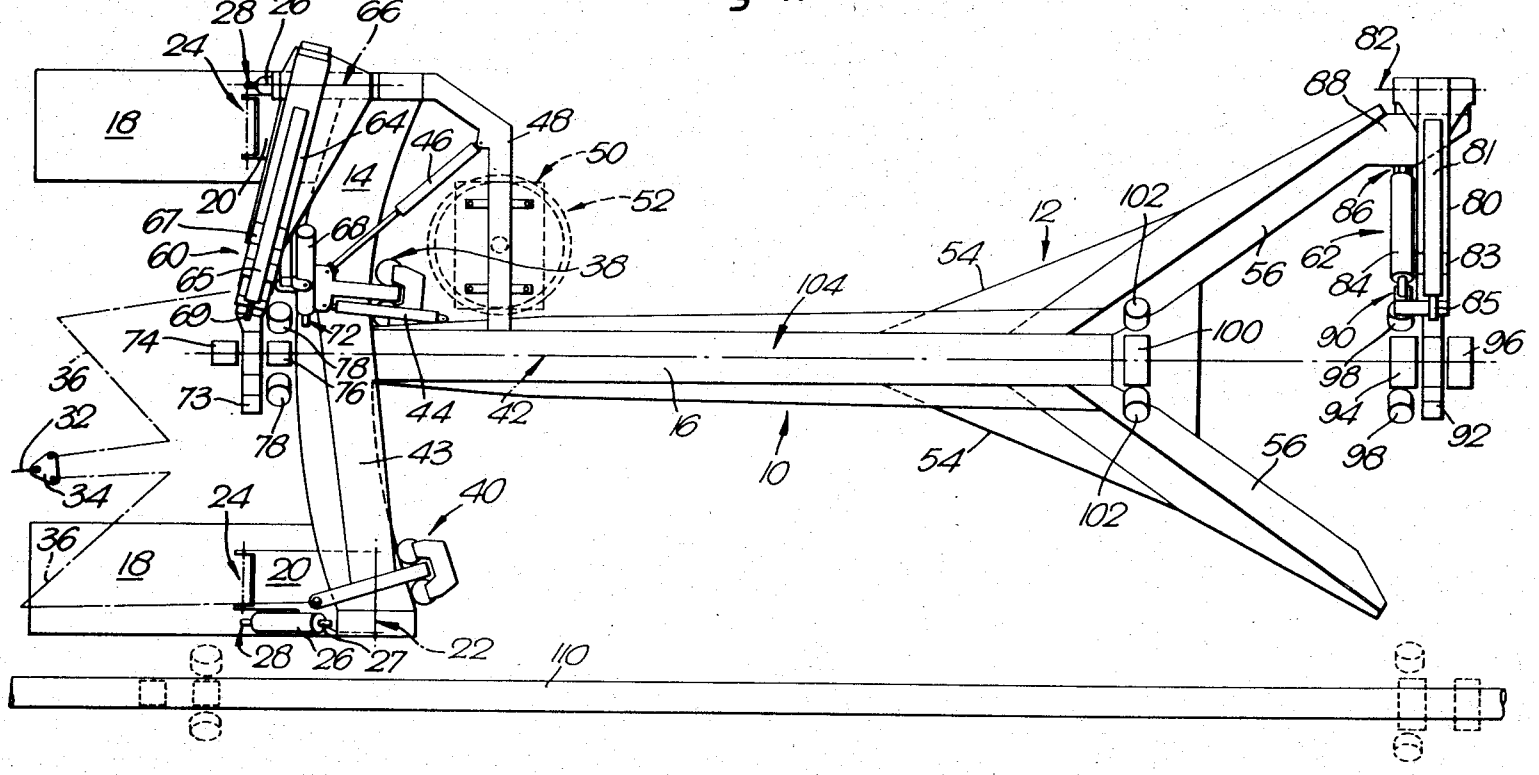
FIGS. 1 and 2 are, respectively, a plan and a side elevation of the plough, with certain parts omitted from FIG. 2 for clarity.

The plough shown in FIGS. 1 to 4 consists of the following principal components: a base structure 10 including a plough body 12 and a curved steering beam 14 with rigidly secured to a plough beam 16 extending lengthwise of the plough; and two plough depth adjustment means in the form of skids 18 at the forward end of the plough, each connected to a respective end portion of the steering beam 14 by an arm 20. Each arm 20 is pivotally connected at its ends at 22, 24 respectively to the beam 14 and to the skid 18.

Each skid 18 is adjustable relatively to the main structure 10 by a respective hydraulic ram 26 having its cylinder pivotally connected at 27 to the beam 14 and its piston rod pivotally connected at 28 to the skid 18 at an axis coincident with the pivot axis at 24 of the arm 20. The skid 18 is free to tilt about the axis 24.

The plough is designed to be towed along the sea-bed 30 by a surface ship (not shown) connected to the plough by a tow cable 32. The cable is secured to a plate 34 forming part of a double-cable bridle 36. The bridle cables 36 are secured to respective steering roller assemblies 38, 40 carried by the steering beam 14. The tow cable 32 can, as shown, be angularly offset from the longitudinal centre-line 42 of the plough, up to some 7° either side, if necessary. Alternatively, the bridle 36 is dispensed with and the tow cable 32 is secured directly to the roller assembly 38. In that case the tow cable is always angularly offset at between 4° and 18° to the same side of the centre line 42 as the roller assembly 38.

The roller assemblies 38, 40 are interconnected by a plate 43 above the beam 14 so as to be movable along the beam together under the action of two hydraulic steering rams 44, 46. The ram 44 is connected between the roller assembly 38 and the beam 16 and the ram 46 between the assembly and a frame 48 extending between the beams 14 and 16. The frame 48 also supports a demountable control pack 50 and a bellmouth guide 52 which safeguards a control umbilical (not shown) extending from the plough controls to the tow ship.

The centre of curvature of the steering beam 14 is behind the leading point of the share 54 of the plough body 12 and the towing force acts effectively on the plough at that centre of curvature. This enables the plough to be readily steered automatically along the pipeline to be buried with considerable independence from the direction of pull exerted by the tow rope, as explained further below.

The plough body 12 also has mould boards 56 and a heel 58.

The main structure 10 carries a front and a rear lifting assembly 60, 62, respectively, the front assembly 60 being mounted on the steering beam 14 adjacent one end of the beam and offset from the centre line 42 to one side of the base structure. The rear lifting assembly 62 is mounted on the trailing end of the mould board 56 of the plough body 12 so as to be offset from the centre line 42 to the same side of the base structure. The front lifting assembly 60 consists of a telescopic arm 64 made up of heavy steel box section components nested one within another in the manner of a conventional telescopic crane jib. The length of the arm 64 is adjustable by a hydraulic ram 65 shown in FIG. 1 but omitted from FIGS. 2 to 4 for clarity. The ram cylinder is mounted in a journal bracket 67 secured to the outer box section of the arm. The outer end of the ram piston rod 69 is connected to the outer end of the inner box section. The arm is angularly adjustable about a horizontal pivot axis 66 by a hydraulic ram 68. The ram 68 has its cylinder pivotally mounted at 70 (FIG. 3) near one end of the outermost box section component of the arm 64. The end of the piston rod of the ram 68 is pivotally connected at 72 (FIG. 1) to the steering beam 14

The innermost component of the arm 64 carries at its outer end a U-shaped mounting 73 supporting a bearer in the form of two horizontal rollers 74, 76, in tandem in a common bracket (not shown) pivotted on the mounting about a horizontal axis. The mounting also supports two inclined rollers 78.

The rear lifting assembly 62 is similar to the front assembly and includes a telescopic arm 80 having a hydraulic ram 81 to adjust its length. The ram is shown in FIG. 1 but omitted from FIGS. 2 to 4 for clarity. The ram cylinder is mounted in a journal bracket 83 secured to the outer box section of the arm. The outer end of the ram piston rod 85 is secured to the outer end of the inner box section. The arm 80 is angularly adjustable about a horizontal axis 82 by a hydraulic ram 84. The cylinder of the ram 84 is pivotally connected at 86 to a bracket 88 on the mould board 56. The ram piston rod is pivotally connected at 90 to a bracket attached to the end of the outermost box section of the arm 80.

The arm 80 carries a U-shaped mounting 92 supporting a bearer in the form of two horizontal rollers 94, 96 in tandem in a common bracket (not shown) pivotted on the mounting about a horizontal axis. The mounting also supports two inclined rollers 98. An additional horizontal roller 100 and two inclined rollers 102 are mounted on the plough body 12 to protect the pipeline as explained below.

The plough body 12 and the beam 16 have upper surfaces defining a longitudinal trough 104 to accommodate the pipeline 110.

OPERATION

The operation of the plough on the seabed is controlled by command signals from an operator on the tow ship aided by closed-circuit television pictures from cameras on the plough and by other signals from monitors on the plough. The signals pass to and from the ship through the umbilical cable connected to the control pack 50.

Preparatory to ploughing the plough is positioned beneath the pipeline by the following steps:

(a) the plough is lowered to the seabed from the towing ship and positioned alongside the pipeline 110 already on the seabed as shown in FIG. 1.

(b) the arms 64 and 80 are both extended and lowered to position the mountings 73 and 92 over the pipeline 110 and slings (not shown) are passed beneath the pipeline 110 and secured to the mountings by divers.

(c) the arms are raised and retracted to position the pipeline over the steering beam and mould board ends. The arms are lowered so that the pipeline rests on the beam and mould board.

(d) the slings are removed.

(e) the arms are retracted, lowered and extended to position the support rollers 74, 76, 78 and 94, 96, 98 beneath the pipeline.

(f) the arms are raised to engage the rollers with the pipeline and to lift the pipeline slightly above the beam and mould board.

Figure 2:
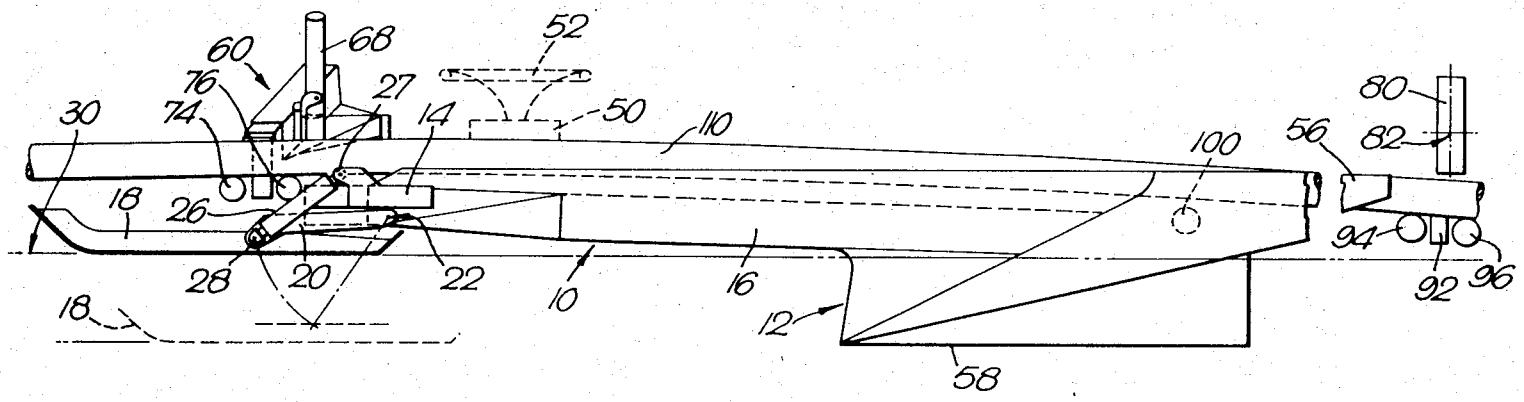
Figure 3:
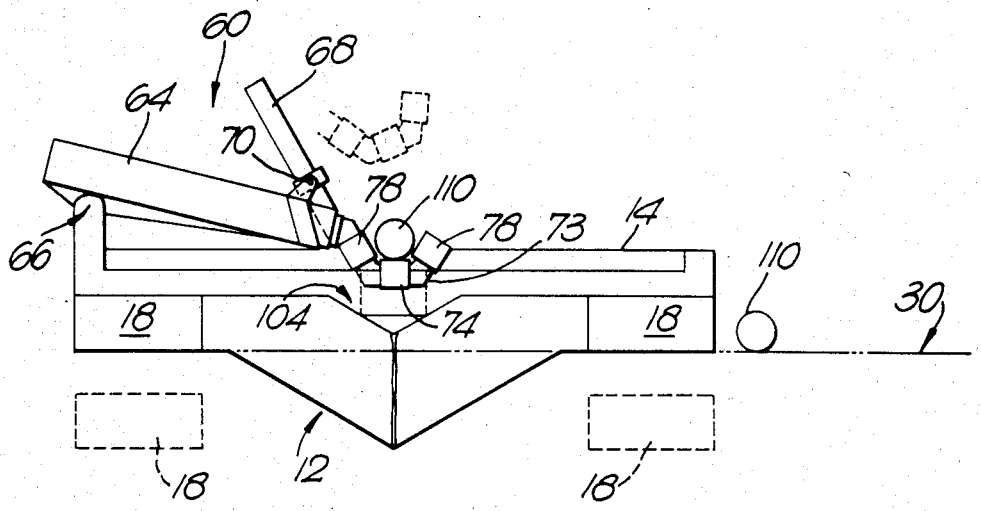
FIGS. 3 and 4 are, respectively, simplified front and rear end views of the plough shown in FIGS. 1 and 2, with the same parts omitted.
Figure 4:
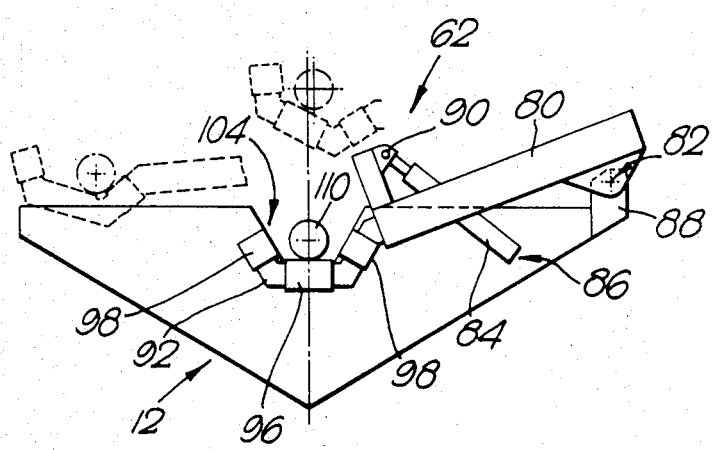

(g) the plough is towed forwards and steered by adjustment of the rams 44, 46 so that it approaches the pipeline 110 as the arms are retracted to bring the centre line 42 beneath the longitudinal central axis of the pipeline 110. The arms are lowered to lower the pipeline into the trough 104. This final position is shown in FIGS. 2 to 4. During this stage the rams 26 are adjusted to raise the skids 18 relatively to the main structure 10 so that the plough body 12 penetrates the seabed to the full depth. The rams 26 are independently operable and to assist the positioning of the plough beneath the pipeline 110, the ram 26 nearest the pipeline can be retracted, the other being extended, so as to tilt the plough sideways. This reduces the maximum height to which the pipeline needs to be lifted to allow the plough to move beneath the pipeline. Stresses on the pipeline are thus minimised.

During ploughing, the plough is towed along the pipeline and the plough body 12 opens a trench into which the pipeline 110 lowers behind the plough. The trench has walls at 30° to the horizontal and typically has a depth up to 1000 millimeters, for example. The pipeline diameter is typically up to 500 mm, for example. The depth of the trench is determined by the setting of the rams 26. The plough beam 16 is relatively low so that stresses in the pipeline are minimized and it is protected from boulders and rocks.

The pipeline is relatively closely restrained laterally and downwardly by the front rollers 74, 76, 78 (see FIG. 3) and less closely restricted by the rear rollers 94, 96, 98 (see FIG. 4). It is not necessary for the plough to impose confining structure above the pipeline which might bear down excessively on top of the pipeline should the plough sink on encountering soft ground.

The plough automatically steers itself along the pipeline 110 and imposes only small forces on the pipeline. The sideways forces are reactions at the rollers 78 which are small because the tow force acts effectively through the centre of curvature of the beam 14 as already referred to. During such normal ploughing the steering rams are set to "float" i.e. the system valves are set to allow the ram pistons to move freely in their cylinders.

As already described, the main function of the assemblies 60, 62 is to enable the pipeline 110 to be handled under the control of the operator as the pipeline is raised and supported, while the plough is maneuvered into its start position beneath the pipeline. During ploughing the pipeline 110 must be supported and guided by bearers on the plough and it is preferred to use the rollers of the assemblies 60, 62 for that purpose.

The changing seabed conditions as ploughing proceeds cause the plough to move up and down and to pitch relatively to the pipeline. In most ploughing applications, such movements are likely to cause the plough to separate from the pipeline leaving it unsupported or to exert undesirable upward loads on the pipeline.

The adjustable assemblies 60, 62 offer a means of reducing or overcoming such problems and it is preferred to arrange for the assemblies to provide yielding support for the pipeline during ploughing as next explained with reference to FIG. 5.

Figure 5:
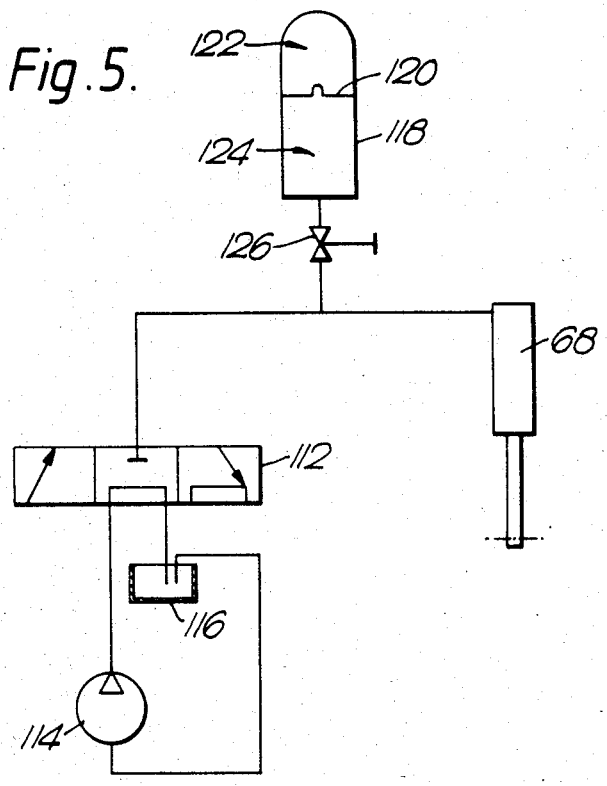
FIG. 5 is a schematic diagram showing a hydraulic accumulator connectable to a ram shown in the preceding figures.

FIG. 5 shows an accumulator and control valve for the ram 68; another accumulator and control valve are similarly arranged for the ram 84. A control valve 112 is operable rightwards from its neutral position shown to supply pressurised hydraulic fluid from a pump 114 to the ram 68 to cause the ram to extend. The pump 114 draws fluid from a reservoir 116. To retract the ram the valve 112 is operated leftwards from its neutral position to allow fluid to pass from the ram to the reservoir.

The accumulator 118 contains a diaphragm 120 separating a body 122 of nitrogen under pressure from the fluid at 124. The accumulator 118 is connected via a valve 126 to the line connecting the valve 112 to the ram 68. While the pipeline 110 is being raised and the plough positioned beneath it, the valve 126 is closed and the accumulator is inoperative. For ploughing operations, the valve 112 is set in its neutral position shown and the valve 126 is opened. The pressure of the nitrogen 122 is thus applied to the fluid in the ram 68 so that the ram can extend and contract automatically in response to pitching and up and down movements of the plough relative to the pipeline to maintain the rollers 74, 76 in supporting contact with the pipeline. Corresponding small variations in the volume of the nitrogen 122 are accommodated by movements of the diaphragm 120.

In a modification (not shown) instead of using two accumulators, one for each ram 68, 84, a single accumulator can be used with each ram connected to the accumulator by a respective valve similar to the valve 126.

Should the plough pitch forwardly excessively, the ram 68 of the rear assembly 62 will contract sufficiently to allow the pipeline 110 to engage the rollers 100, 102, which safeguard the pipeline from damage.

In a modification (not shown) only one assembly, preferably the front assembly 60, provides yielding support for the pipeline during ploughing, the other assembly being set to remain in a fixed position by operation of its hydraulic valves.

Figure 6:
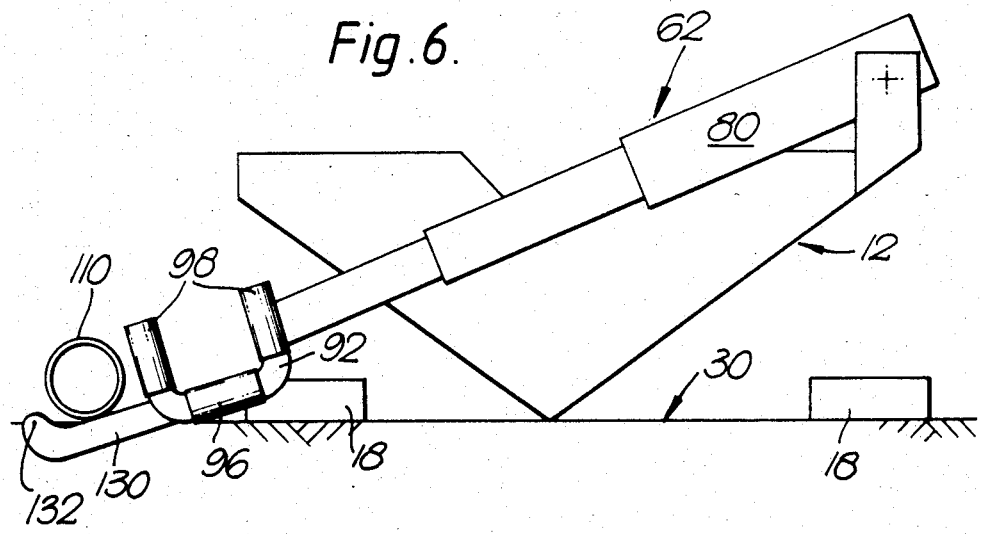
FIGS. 6 and 7 are schematic end views of modified ploughs.

One arm or both arms can be modified as shown in FIG. 6 in which one arm is shown having an extension 130. The arm can be extended to push the extension 130 beneath the pipeline 110 after which the arm is raised. The pipeline is preferably retained on the extension 130 by an upwardly-extending abutment 132 on the extension. The pipeline is thus raised a small distance without the need for the use of the slings. The other arm is then lowered and extended to position its rollers beneath the pipeline and raised to lift the pipeline off the extension 130. The arm shown is then adjusted to position its rollers beneath the pipeline. Such a modification can eliminate or reduce the assistance of divers during the loading operation.

Figure 7:
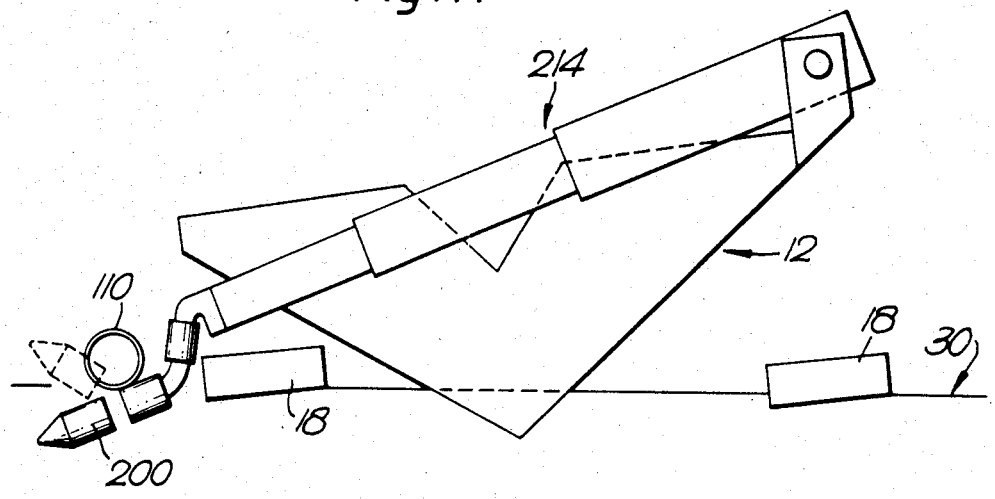
Figure 8:
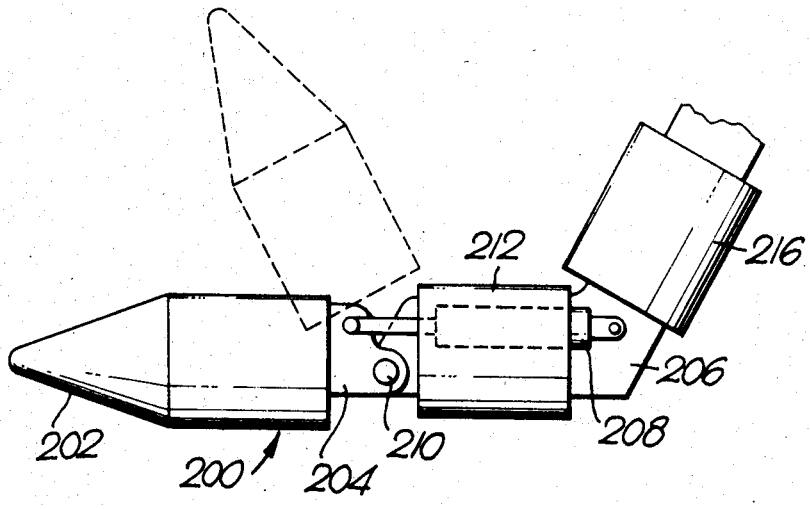
FIG. 8 is an enlarged view of part of FIG. 7.

One arm or both arms can be modified as shown diagrammatically in FIGS. 7 and 8 to enable the pipeline to be lifted without using divers. The outermost roller 200 has a pointed nose 202. The outermost limb 204 of the mounting 206 is angularly adjustable by a hydraulic ram 208 about a pivot 210. The roller 200 can thus be moved between two positions, a lower one as shown in full lines in FIG. 8 and a raised position shown by broken lines. The ram 208 is positioned between the tandem rollers 212 forming the bearer.

When the roller 200 occupies the lower position it can be pushed endwise beneath the pipeline 110, resting on the sea-bed, by extension of the arm 214 (FIG. 7). The nose 202 assists the roller 200 in penetrating the sea-bed soil. The roller 200 is then adjusted towards its raised position as the roller passes behind the pipeline 110. The arm 214 can be raised at the same time to lift the pipeline 110 slightly. The pipeline 110 can thus be captured between the raised roller 200 and the other inclined roller 216.

The pipeline 110 can be raised further to enable the bearer of the other arm to be positioned beneath the pipeline 110. If both arms carry angularly adjustable rollers, the arms can be operated so as to capture the pipeline together.

In a modification (not shown) one or each of the arms 64, 80 can be swung downwardly by its ram 68, 84 so as to engage the respective mounting 73, 92 with the sea-bed. Continued movement of the ram in the same sense raises the plough slightly. Then, retraction of the arm by the other ram 65, 81 moves the plough sideways. The arms may be modified so as to be slewed about vertical axes by further rams to enable the plough to be moved lengthwise by manipulation of an arm or arms engaging the sea-bed.

FIG. 7 shows how, if required, the plough can be tilted sideways by unequal adjustment of the rams 26 to reduce the height to which the pipeline 110 must be lifted to allow the plough body 12 to be positioned beneath the pipeline 110.

Ploughs according to the invention can be used to plough pipeline trenches on dry land, as well as on the sea-bed or on the beds of other bodies of water.

I claim:

1. A pipeline plough comprising a base structure, a plough body and ploughing depth adjusting means both said body and said means forming part of said base structure, front and rear lifting assemblies carried by said base structure and spaced apart in the lengthwise direction thereof, front and rear bearer means and front and rear actuator means forming parts of said front and rear assemblies, respectively, said actuator means being operable to adjust said respective assemblies to lift the pipeline supported by said bearer means while the plough is positioned to one side of the pipeline and to support the pipeline while the plough approaches the pipeline from said one side to position said plough body beneath the pipeline.

2. A pipeline plough comprising a plough body, a transverse beam ahead of said body, a longitudinal beam interconnecting said body and said transverse beam, ploughing depth adjusting means connected to said transverse beam, front and rear lifting assemblies carried respectively by said transverse beam and said body and mounted thereon at respective locations offset towards one side of said base structure, front and rear bearer means, and front and rear actuator means forming parts of said front and rear lifting assemblies, respectively, said actuator means being operable to adjust said respective assemblies to lift the pipeline supported by said bearer means while the plough is positioned to one side of the pipeline and to support the pipeline while the plough approaches the pipeline from said one side to position said plough body beneath the pipeline.

3. A plough according to claim 1, in which each said lifting assembly comprises members arranged in telescopic relationship to form an arm adjustable in length by relative telescopic movements of said members, said arm carrying said respective bearer means, said plough further comprising respective pivotal mounting means for each said arm providing a horizontal axis about which said arm is angularly adjustable.

4. A plough according to claim 1, in which said depth adjusting means comprises two adjustable means, which are positioned one at each side of said plough and which are independently adjustable to tilt said plough sideways to reduce the maximum height to which the pipeline need be lifted.

5. A plough according to claim 1, in which at least one of said lifting assemblies comprises an extension which by adjustment of said one assembly is advanceable endwise to a position beneath the pipeline while the pipeline lies on the ground and which lifts the pipeline upon subsequent adjustment of said one lifting assembly.

6. A plough according to claim 1, in which at least one of said lifting assemblies comprises an elongate member which is angularly adjustable between two positions in the first of which said member is, by adjustment of said one assembly, advanceable endwise to pass beneath the pipeline resting on the ground and in the second of said two positions said member is raised relatively to said first position to capture the pipeline and retain it upon said respective bearer means.

7. A plough according to claim 1, further comprising further means operable during ploughing to cause at least one of said lifting assemblies to force said respective bearer means upwardly against the pipeline while allowing said one assembly to adjust automatically to accommodate pitching and up and down movements of said plough relative to the pipeline.

8. A plough according to claim 7, in which actuator means comprise hydraulic ram means and in which said further means comprise a hydraulic accumulator and hydraulic valve means selectively operable to connect said hydraulic accumulator to said hydraulic ram means of said at least one lifting assembly.

9. A plough according to claim 2, in which said base structure has upper surfaces defining a longitudinal trough which accommodates the lower portion of the superimposed length of said pipeline when said plough has been positioned beneath said pipeline.

* * * * *